US010482852B2

(12) United States Patent
Douglas

(10) Patent No.: US 10,482,852 B2
(45) Date of Patent: Nov. 19, 2019

(54) BUTTON FRETBOARD ASSEMBLY FOR AN INSTRUMENT

(71) Applicant: William L. Douglas, Tucson, AZ (US)

(72) Inventor: William L. Douglas, Tucson, AZ (US)

( * ) Notice: Subject to any disclaimer, the term of this patent is extended or adjusted under 35 U.S.C. 154(b) by 0 days.

(21) Appl. No.: 16/280,030

(22) Filed: Feb. 19, 2019

(65) Prior Publication Data

US 2019/0311698 A1 Oct. 10, 2019

Related U.S. Application Data

(60) Provisional application No. 62/653,536, filed on Apr. 5, 2018.

(51) Int. Cl.
*G10D 3/06* (2006.01)
*G10D 3/08* (2006.01)

(52) U.S. Cl.
CPC ..... *G10D 3/08* (2013.01)

(58) Field of Classification Search
CPC ..... G10D 3/08
USPC ..... 84/314 N
See application file for complete search history.

(56) References Cited

U.S. PATENT DOCUMENTS 3,433,112 A * 3/1969 Bradt ..... G10D 3/08 84/317
4,204,454 A * 5/1980 Severn ..... G09B 15/06 84/315
4,545,281 A * 10/1985 Habicht ..... G10D 3/08 84/315

* cited by examiner

*Primary Examiner* — Jianchun Qin
(74) *Attorney, Agent, or Firm* — Thomas W. Galvani, P.C.; Thomas W. Galvani

(57) ABSTRACT

An assembly for an instrument includes a fretboard having a width, a length, a top surface, frets projecting from the top surface and spaced apart along the length, strings arranged above the top surface across the width, and recesses formed into the fretboard between the frets and below the strings. A button is carried in each recess for reciprocal movement along an axis between a raised position and a depressed position. In the depressed position, the button is in contact with one of the strings and depresses the one of the strings against a proximate fret. In the raised position, the button is out of contact with the one of the strings.

17 Claims, 4 Drawing Sheets

BUTTON FRETBOARD ASSEMBLY FOR AN INSTRUMENT

CROSS-REFERENCE TO RELATED APPLICATIONS

This application claims the benefit of U.S. Provisional Application No. 62/653,536, filed Apr. 5, 2018, which is hereby incorporated by reference.

FIELD OF THE INVENTION

The present invention relates generally to musical instruments, and more particularly to plucked or strummed string musical instruments.

BACKGROUND OF THE INVENTION

The lute family of instruments includes instruments which a sounding body, a neck, and strings strung from the body to the neck. It includes guitars, banjos, mandolins, ukuleles, and other plucked string instruments. These are extraordinary instruments capable of producing a wide range of sounds, tones, chords, and effects. Learning to play a lute instrument such as a guitar is correspondingly difficult. There are many obstacles to learning to play.

For example, beginners have difficulty holding strings down. Depressing a string can require a great deal of force. Playing some chords requires awkward contortions of the fingers, too. It is difficult at first to depress a string when one's fingers are bent oddly. It is usually uncomfortable. Moreover, acoustic strings are generally fairly rigid and can hurt the fingertips; in fact, most serious musicians develop callouses on their fingers from repeated wear against the strings.

When strings are not fully depressed, they can buzz or fail to sound at all. This can ruin a single note and will disrupt the harmony within a chord, causing dissatisfaction to the novice musician.

Another problem that beginners frequently have is caused by imprecise placement of their fingers. A finger depressing one string can inadvertently touch an adjacent string. This can deaden the adjacent string and prevent it from producing any sound. Problems such as these can be discouraging for a beginner and lead to many novices giving the guitar or other string instrument up too soon. A better way to depress a string is needed.

SUMMARY OF THE INVENTION

An assembly for an instrument includes a fretboard having a width, a length, a top surface, frets projecting from the top surface and spaced apart along the length, strings arranged above the top surface across the width, and recesses formed into the fretboard between the frets and below the strings. A button is carried in each recess for reciprocal movement along an axis between a raised position and a depressed position. In the depressed position, the button is in contact with one of the strings and depresses the one of the strings against a proximate fret. In the raised position, the button is out of contact with the one of the strings.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
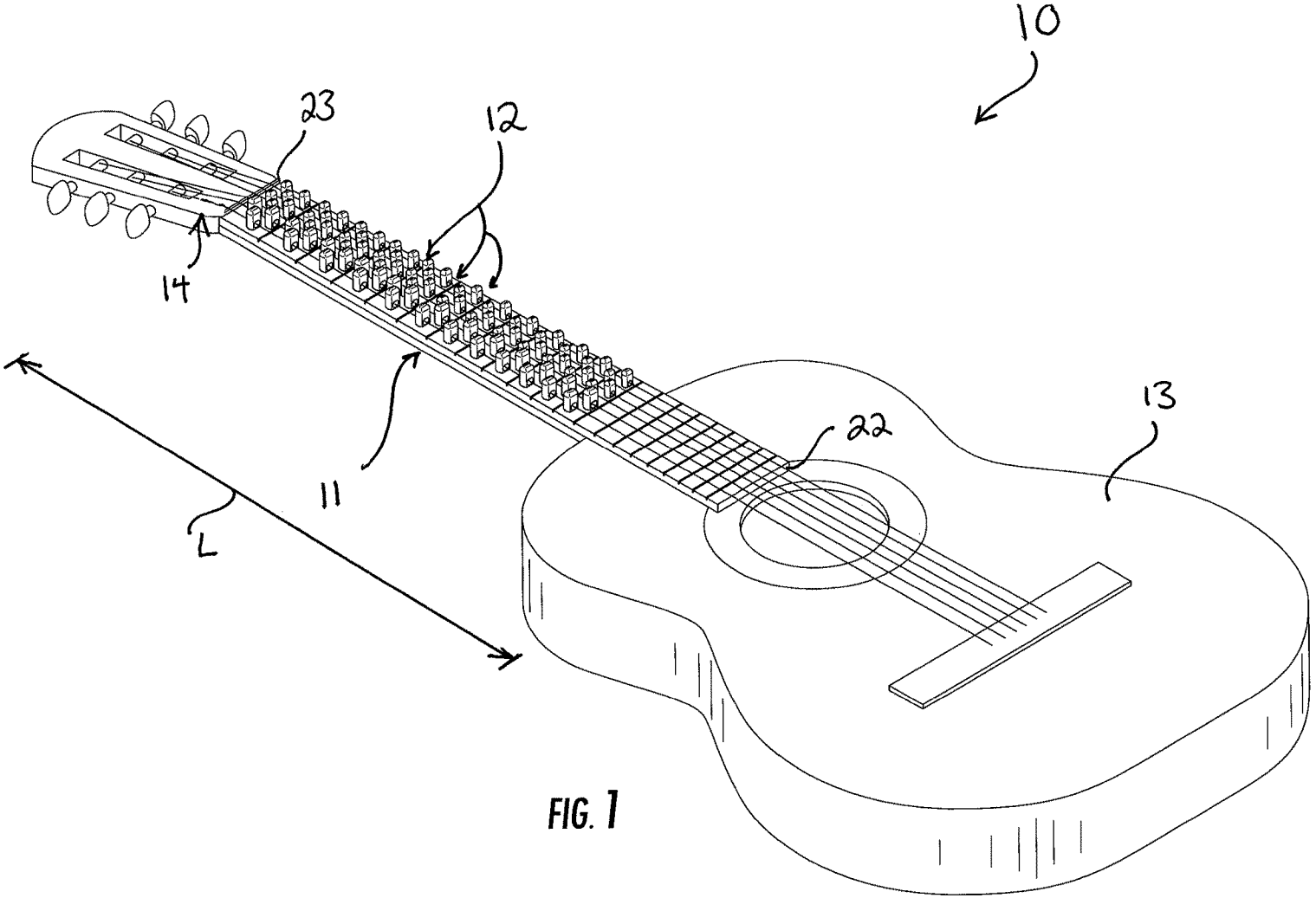
FIG. 1 is a top perspective view of an instrument with button fretboard.

Reference now is made to the drawings, in which the same reference characters are used throughout the different figures to designate the same elements. FIG. 1 is a top perspective view of a guitar 10 with a button fretboard 11. The guitar 10 is an acoustic guitar, and is exemplary of many of the instruments within the lute family. The inventive fretboard 11 is equally applicable to amplified guitars, electric guitars, banjos, mandolins, ukuleles, and other plucked string instruments in the lute family which have a neck or fretboard across which strings extend. The fretboard 11 allows a musician to easily and surely depress a string without disrupting adjacent strings. The fretboard 11 is covered with a large plurality of buttons 12, each of which is mounted for reciprocal movement between a raised position and a depressed position, so that any of the buttons 12 can be depressed onto a string, thereby surely altering the pitch of the note the string plays.

Figure 2:
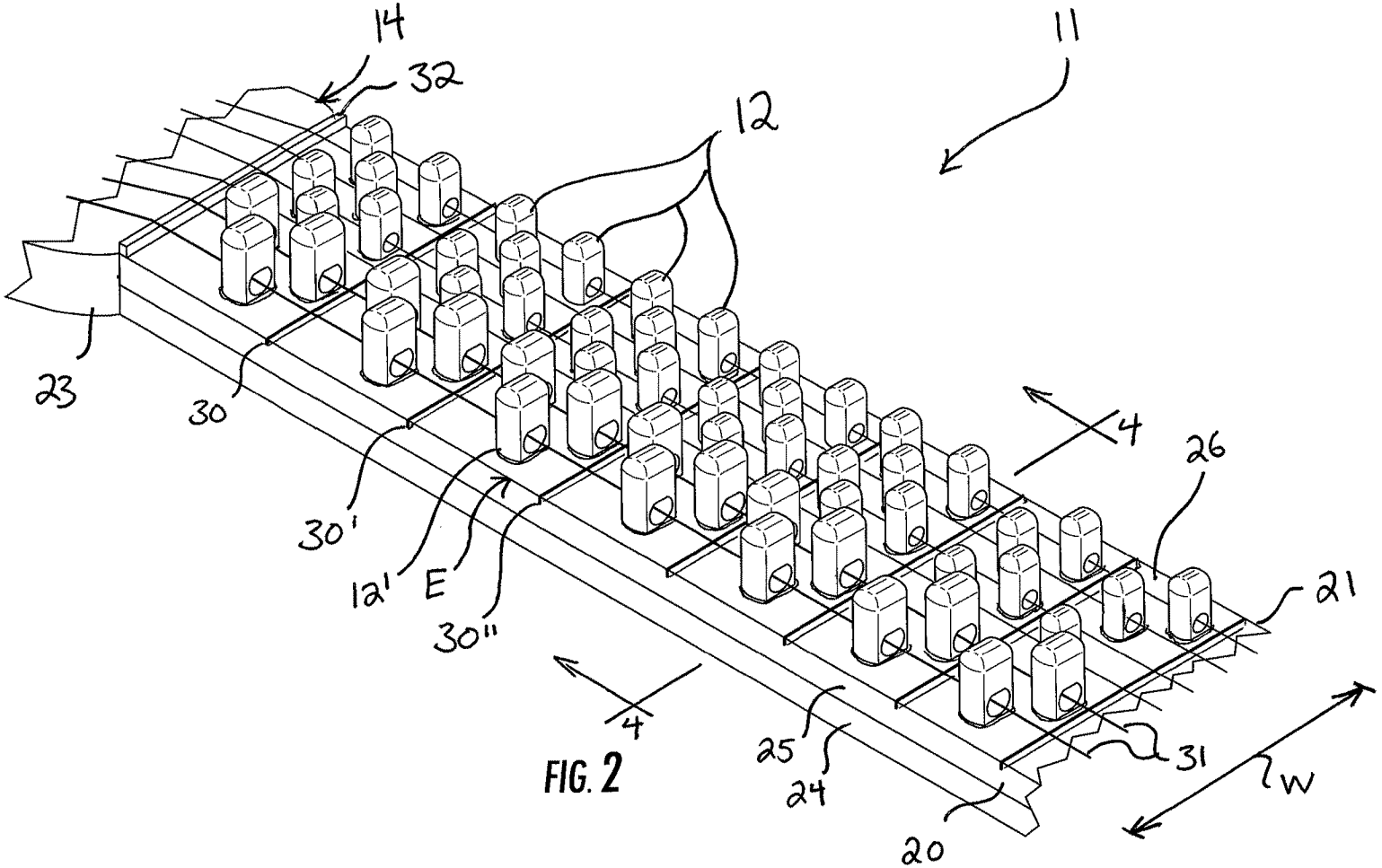
FIG. 2 is an enlarged top perspective view of the button fretboard of FIG. 1.

FIG. 2 is an enlarged top perspective view of the fretboard 11. The fretboard 11 has opposed sides 20 and 21, a proximal end 22 near a body 13 of the guitar 10, and a distal end 23 near a headstock 14 of the guitar 10 (as seen in FIG. 1). Between the opposed sides 20 and 21, the fretboard 11 has a width W, and between the opposed ends 22 and 23, the fretboard 11 has a length L (as seen in FIG. 1). The fretboard 11 is preferably formed from a bottom plate or lower frame member 24 and a top plate or upper frame member 25 adhered, bonded, fastened, or otherwise fixed to each other. While these drawings show such a two-layer fretboard 11, in other embodiments, the fretboard 11 is constructed from a single layer, three layers, or more. The upper frame member 25 has a top surface 26; this top surface 26 extends entirely across the fretboard 11 from the proximal end 22 to the distal end 23 and between the opposed sides 20 and 21.

Frets 30 project up from the top surface 26 of the fretboard 11. The frets 30 are spaced apart along the length L. Each fret 30 is a strip (preferably constructed from a metal such as nickel, brass, or a combination of these or other materials) which is embedded into the fretboard 11. Across and above the frets 30 are strung strings 31. The strings 31 are arranged in a spaced-apart fashion across the width W above the top surface 26. While six strings 31 are shown in these drawings, the present disclosure is not limited to six strings; obviously, guitars and other lute instruments have more or less strings 31. The strings 31 extend from the body 13 of the guitar 10, along the length L of the fretboard 11, and over a nut 32 to be adjustably secured into the headstock 14. The strings 31 are threaded through the buttons 12.

The buttons 12 are arranged across the fretboard 11 and carried in recesses 33. On some strings 31, between some frets 30, there is only a single button 12, while on other strings 31, between adjacent frets 30, there are two buttons 12. In other embodiments, there may be three, four, or more buttons 12 between adjacent frets 30, depending on the need, the size of the buttons 12, and the spacing between adjacent frets 30. "Adjacent frets" are frets 30 which are proximate each other and have no intervening fret 30 between them.

Figure 3A:
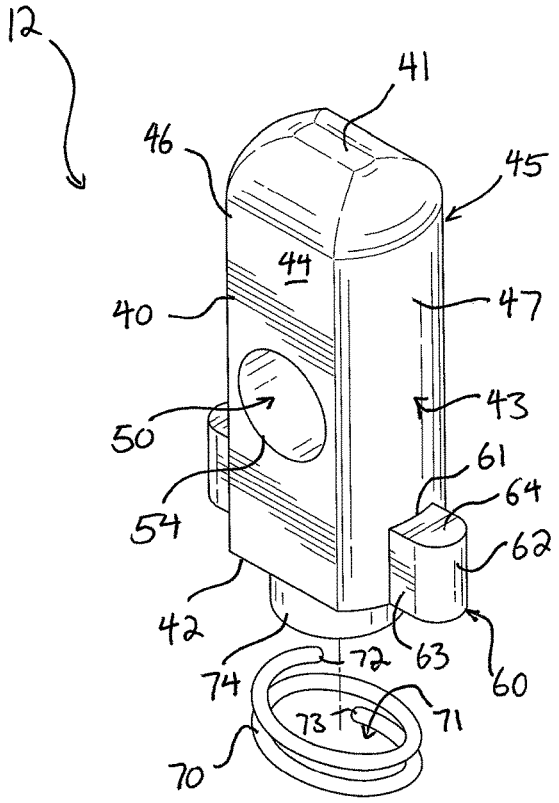
FIGS. 3A and 3B are top and bottom perspective views of a button from the button fretboard of FIG. 1.
Figure 3B:
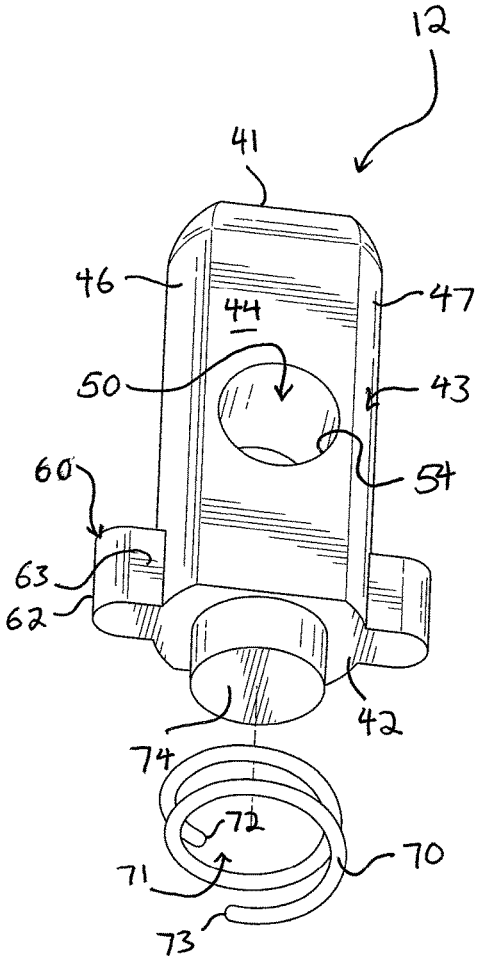

FIGS. 3A and 3B are detailed top and bottom perspective views of an exemplary button 12. The buttons 12 on the fretboard 11 differ in size, with a "large" button and a "small button," though certainly other sizes are within the scope of the disclosure. Generally, but not necessarily, the large buttons 12 are appropriate for use with the larger strings and the smaller buttons 12 are appropriate for use with the smaller strings, though this may be altered depending on the needs of the musician. The buttons 12 are structurally identical in every respect but one, which is set out and explained below. Despite this lone difference, one having ordinary skill in the art will understand that the ensuing description of the exemplary button 12 and its various structural elements and features applies equally to all buttons 12 for the fretboard 11. The button 12 shown in FIGS. 3A and 3B happens to be a small button 12.

The button 12 includes a roughly oval-shaped body 40 having a top 41, a bottom 42, and an outer surface 43. Proximate the top 41, the button 12 has a truncated oval dome shape. The bottom 42 is flat but for features formed thereon, as will be explained. The button 12 is preferably solid and formed from a single, integral, monolithic material or combination of materials. The button 12 has a front 44 and opposed rear 45 which are flat faces parallel to each other. Between the front 44 and rear 45 are arcuate sides 46 and 47 that each smoothly transition from the front 44 and rear 45. The button 12 is slightly wider between the sides 46 and 47 than it is between the front 44 and rear 45, such that it has a roughly oval-shaped cross-section.

The button 12 has a bore or hole 50 formed transversely and entirely through the body 40 from the front 44 to the rear 45. One of the strings 31 is passed through this hole 50. In the button 12 shown in FIGS. 3A and 3B, the hole 50 has a cylindrical inner surface 51, which is preferably regular and round. However, in the large button 12 (shown in FIGS. 4A and 4B, proximate two small buttons 12), the hole 50 has a quasi-cylindrical inner surface 52 and a flat upper surface 53. The flat upper surface 53 shortens the height of the hole 50 while maintaining the width of the otherwise circular hole 50, which allows larger strings 31 to vibrate without interference with the hole 50. In these embodiments, the inner surface 51 (or the inner surface 52 and upper surface 53) meets the outer surface 43 at a sharp edge 54. The sharp edge 54 on the small button 12 in FIGS. 3A and 3B is curvilinear, extending entirely around and bounding the hole 50. On the large button 12 in FIGS. 4A and 4B, the sharp edge 54 is rectilinear across the top of the hole 50 and curvilinear around the rest of the hole 50. On each button 12, there are two sharp edges 54—one at the front 44 and one at the rear 45.

At the bottom 42 of the button 12, two laterally-projecting fingers 60 extend radially outward. The fingers 60 assist in guiding reciprocal movement of the button 12 and preventing rotation of the button 12 in the recess 33. The fingers 60 are opposite and identical, and only one will be described. The finger 60 is roughly rectangular prismatic and has an inner end 61 and an opposed outer end 62 as well as opposed side faces 63 extending therebetween. The inner end 61 of the finger 60 is formed integrally to the outer surface 43 of the button 12; indeed, the finger 60 is formed integrally and monolithically to the button 12 as a single piece. The finger projects outwardly from a center of the bottom 42 of the button 12 to the outer end 62 beyond the outer surface 43, and the outer end 62 is arcuately curved. The side faces 63 are flat faces parallel to each other and parallel to the front 44 and rear 45.

The finger 60 has a flat top 64 which is parallel to the bottom 42 of the button 12. The finger 60 also has a flat bottom which is opposed to the top 64 and which is contiguous to the bottom 42 of the button 12. The top 64 of the finger 60 is below the hole 50.

A spring 70 under the button 12 controls the reciprocal movement of the button 12. The spring 70 is a helical compression spring wound about—or bounding—an empty cylindrical hollow 71. The spring 70 has an upper end 72 and an opposed lower end 73. The upper end 72 is directed in contact against the bottom 42 of the button 12. A central, cylindrical post 74 projects from the bottom 42 of the button 12 and is shaped and sized to correspond with the hollow 71 in the spring 70. When the spring 70 is applied to the button 12, it is captured on the post 74; the upper end 72 of the spring 70 is in contact with the bottom 42 of the button 12, and the hollow 71 is positioned onto and around the post 74. This holds the spring 70 on the button 12. In some embodiments of the button 12, the bottom 42 is entirely flat and no post 74 is formed thereon. In such embodiments, the spring 70 is held in the hold 80 between the bottom 42 of the button 12 and the bottom 80 of the recess 33 and still acts to bias the button 12 toward the raised position thereof.

Figure 4A:
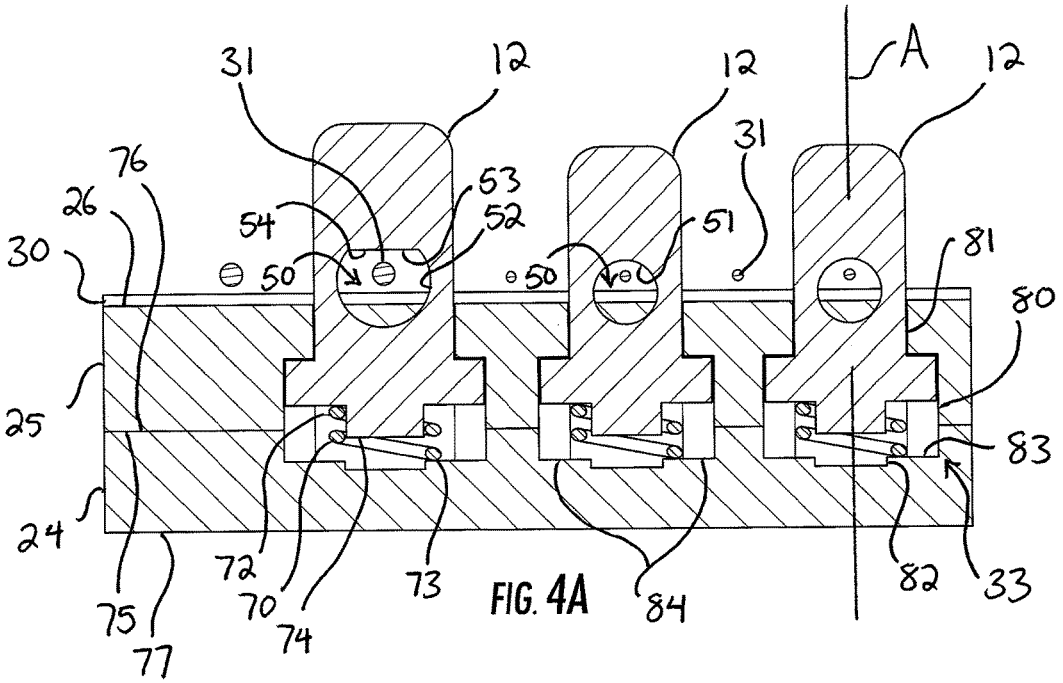
FIGS. 4A and 4B are section views taken through the button fretboard along line 4-4 in FIG. 2, showing buttons in raised and depressed positions, respectively.
Figure 4B:
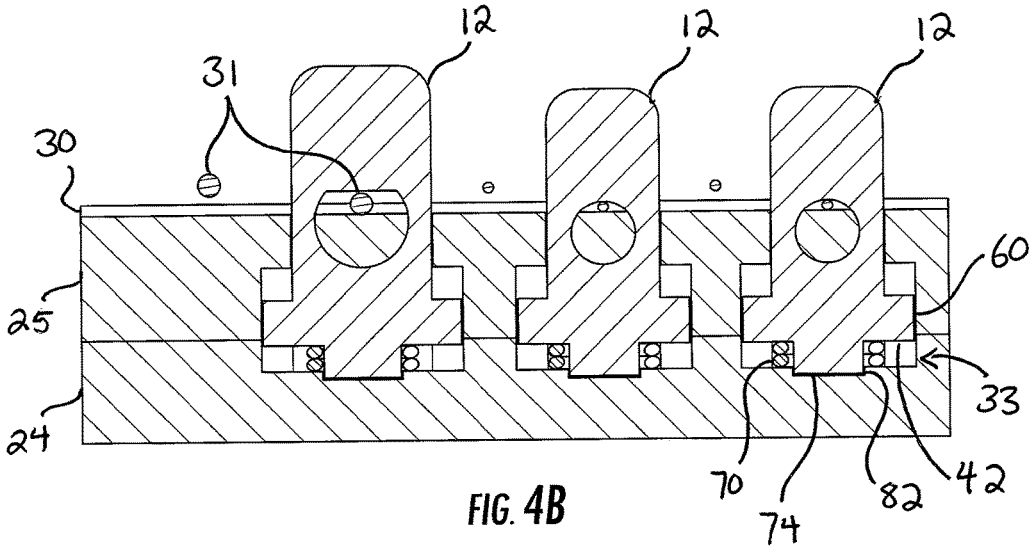

The spring 70 is compressed under the button 12, and the spring 70 biases the button 12 into the raised position. Turning to FIGS. 4A and 4B, the fretboard 11 is shown in section view along the line 4-4 in FIG. 2. The recesses 33 are formed into the fretboard 11 to receive and hold the buttons 12 and the springs 70. Indeed, the buttons and springs 70 are captured in the recesses 33 between the lower and upper frame members 24 and 25 which define the fretboard 11.

The upper frame member 25 is a long, thin member having roughly the same size and shape as a conventional fretboard. The upper frame member 25 caps or covers over the buttons 12 but for their tops 41. It has a transverse width and a longitudinal length equal to the width W and length L of the fretboard 11. It has opposed sides which cooperate with sides of the lower frame member 24 to define the sides 20 and 21 of the fretboard 11. The upper frame member 25 includes the top surface 26, and has an opposed bottom surface 75.

Opposite the upper frame member 25, the lower frame member 24 holds the buttons 12 and the springs 70 from below. The lower frame member 24 is a long, thin base having roughly the same size and shape as a conventional fretboard. It has a transverse width and a longitudinal length equal to the width W and length L of the fretboard 11. The lower frame member 24 has opposed sides which cooperate with the sides of the upper frame member 25 to define the sides 20 and 21 of the fretboard 11. The lower frame member 24 has a top surface 76 and an opposed bottom surface 77. The top surface 76 of the lower frame member 24 is adhered, bonded, fastened, or otherwise fixed to the bottom surface 75 of the upper frame member 25. The lower and upper frame members 24 and 25 therefore are securely fastened together to define the neck of the guitar 10 and to define the recesses 33 for holding the buttons 12 through which the strings 31 of the guitar 10 are strung.

Like the buttons 12, the recesses 33 are generally of two different sizes but are otherwise structurally identically, and so reference will be made to either of the large and small recesses 33 in FIGS. 4A and 4B for clarity of the drawings. The recess 33 has an enlarged hold 80, a shaft 81 extending upward from the hold 80, and a socket 82 extending downward from the hold 80. The recess 33 has a bottom 83 at the bottom of the hold 80. The recess 33 is formed in both the lower frame member 24 and the upper frame member 25; the hold 80 is formed in both, while the shaft 81 is formed only through the upper frame member 25 and the socket 82 is formed only in the lower frame member 24.

The recess 33 has a shape that closely corresponds to the button 12 so as to snugly receive the button 12. The hold 80 is elongate and has a larger opening with two opposed peripheral slots 84 extending therefrom, to accept the body 40 and receive the fingers 60 of the button 12. The shaft 81 is an oval slot, open at its top, that receives the body 40 of the button above the fingers 60. The socket 82 is a shallow, blind, and cylindrically-shaped depression into the lower frame member 24. The hold 80 has a height that is approximately two or two-and-a-half times larger than the height of the fingers 60 between their tops 64 and the bottom 42, though the button 12 is unlikely to reciprocate through that full vertical distance.

The buttons 12 reciprocate along an axis A between the raised and depressed positions shown in FIG. 4A and FIG. 4B, respectively. The buttons 12 move directly and solely along the axis A, prevented from movement in other directions. The spring 70 is compressed under each button 12 against the top surface 76 of the lower frame member 24, within the recess 33, and urges the button 12 upward. The button 12 is prevented from moving out of the recess 33 by the limiting interaction of the fingers 60 with the underside of the recess 33; because the fingers 60 are wider than the shaft 81 of the recess 33, the fingers 60 stop the button 12 from moving out of the recess 33. Further, the post 74 and the spring 70 limit the extend of downward movement of the button 12 in the recess 33 when the button is moving to the depressed position. When the button 12 is fully depressed, the post 74 is seated in the socket 82, and the spring 70 is fully compressed so that its windings are in touch with each other. In this position, the bottom 42 of the button 12—and of the fingers 60—is spaced vertically above the bottom 83 of the hold 80 of the recess 33, defining a gap between the bottom 42 of the button 12 and the bottom 83 of the recess 33.

In operation, a musician holds the guitar 10 as he would a conventional guitar. The following description refers primarily to FIGS. 2, 4A, and 4B. Again, it is noted that although the drawings here show an acoustic guitar, the description applies equally to any instrument of the lute family, including but not limited to amplified guitars, electric guitars, banjos, mandolins, ukuleles, and other plucked string instruments in the lute family. With the palm of his hand against the lower frame member 24, his thumb is laid against the lower frame member 24 or over the side 20, and his fingers reach around the fretboard 11, along the side 21, so that his fingers come up, over, and above the array of buttons 12. The musician can then depress a single button 12 or a combination of buttons 12.

It is noted briefly here that the array shown in FIG. 2 is preferred but non-limiting. As mentioned above, the buttons 12 are arranged across the fretboard 11. This arrangement can be changed by a manufacturer or customized for the individual musician. On some strings 31, between some frets 30, there is only a single button 12, while on other strings 31, between adjacent frets 30, there are two buttons 12. In other embodiments, there may be three, four, or more buttons 12, depending on the need, the size of the buttons 12, and the spacing between adjacent frets 30. There may additionally be "button blanks," where no button is located on the string 31, so as to force the musician to use or her fingers in a certain way, or perhaps to allow a musician to acquire a certain handhold on the guitar 10.

By depressing a single button 12, the musician causes the button 12 to move downward, compressing the spring 70 between the bottom 42 of the button 12 and the bottom 83 of the recess 33. The confinement of the fingers 60 of the button 12 within the slots 84 of the hold 80 prevents the button 12 from rotating or moving in directions other than along the axis A as it is depressed, in case the musician twists or rotates his finger. In the raised position, the bottom of the hole 50 is slightly below the top surface 26 and further below the top of the fret 30. In the raised position, the string 31 is our of contact with the button 12, and the string 31 can be played "open." As the button 12 moves downward, the bottom of the hole 50 slips further below the top surface 26. The top of the hole 50 comes into contact with the string 31 on which the button 12 is disposed, and the button 12 continues to move down, bending the string 31 downward as well.

When the button 12 is fully depressed into the depressed position, the string 31 is caught between the top of the hole 50 and the top surface 26 of the fretboard 11 between the same frets 30 that the button 12 is located between. The string is held firmly and surely against the top surface 26, and extends out from the hole 50 between the top surface 26 and the sharp edge 54 of the hole 50. The string 31 then extends up away from the top surface 26 and over the proximate fret 30, or the fret which adjacent the button 12 and which is closer to the body 13 of the guitar 10. For instance, briefly referring to FIG. 2, if the button 12' is considered on the E string 31, then the adjacent frets 30 and the frets marked 30' and 30". The proximate fret 30 is the fret 30" because it is the adjacent fret 30 which is closer to the body 13 of the guitar 10. When the button 12' is depressed, the E string 31 will be depressed against the top surface 26 of the fretboard 11 and will then extend in contact against and over the proximate fret 30", down toward the body 13 of the guitar 10.

This shortens the effective length of the string 31. When the string 31 is plucked or strummed, the string 31 vibrates from the hole 50, as if a finger were directly and cleanly depressing the string itself against the top surface 26 of the fretboard 11. In this way, the button 12 ensures positive and firm contact to shorten the effective length of the string 31 and thereby set the note that the string 31 plays. When the musician removes his or her finger from the button 12, the spring 70 biases the button 12 to return to the raised position from the depressed position, and it does so quickly.

Multiple buttons 12 can be depressed in a similar fashion. The musician uses two, three, or four fingers to depress a corresponding number of buttons 12. He may depress buttons 12 in the same fret position or he may reach across frets 30 to depress buttons 12 at different fret positions. Because there are multiple buttons 12 on each string 31 within frets 30, the musician can press one of several buttons for each string 31, thereby giving him flexibility to accommodate otherwise difficult fingering positions.

When playing a chord with an open note, the musician will depress two, three, or four buttons 12 but will also strum a string that is "open," or not depressed at all by a button 12. The open fret 30 will vibrate within the many holes 50 of the buttons 12 positioned on that fret 30 along the length of the fretboard 11. The width of each hole 50 is sufficient to allow the fret 30 to vibrate without contact or impingement. This preserves the quality of such open notes.

The button fretboard 11 is also compatible with conventional capos. When playing with a capo to shorten the effective length of all frets 30, the musician merely applies the capo over the buttons 12 for each fret 30 in a fret position. The musician then places his fingers to play notes and chords according to the above description.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. An assembly for an instrument, the assembly comprising:

a fretboard having a width, a length, a top surface, frets projecting from the top surface and spaced apart along the length, strings arranged above the top surface across the width, and recesses formed into the fretboard between the frets and below the strings;

a button is carried in each recess for reciprocal movement along an axis between a raised position and a depressed position, wherein the button has a hole formed transversely through the button, and one of the strings is passed through the hole;

in the depressed position, the button is in contact with the one of the strings and depresses the one of the strings against a proximate fret; and in the raised position, the button is out of contact with the one of the strings.

2. The assembly of claim 1, wherein:

the recess includes a cavity and a peripheral slot in communication with the cavity;

the button has a body and a finger extending from the body; and the body of the button is received in the cavity, and the finger of the button is received in the slot, wherein the slot limits movement of the button in directions other than along the axis.

3. The assembly of claim 1, wherein the button is biased toward the raised position.

4. The assembly of claim 1, wherein:

the button has a top and a bottom, and a post projecting from the bottom; and a spring is captured on the post and disposed in the recess between a bottom of the recess and the bottom of the button.

5. The assembly of claim 1, wherein the hole has a cylindrical inner surface.

6. The assembly of claim 1, wherein the hole has a quasi-cylindrical inner surface and a flat upper surface.

7. An assembly for an instrument, the assembly comprising:

a fretboard having a width, a length, a top surface, frets projecting from the top surface and spaced apart along the length, and strings arranged above the top surface across the width;

between adjacent frets, recesses formed into the fretboard below the strings;

in each of the recesses between adjacent frets, a button is carried for reciprocal movement between a raised position and a depressed position, wherein the button has a hole formed transversely through the button, and one of the strings is passed through the hole;

in the depressed position, the button is in contact with the one of the strings and depresses the one of the strings against a proximate fret; and in the raised position, the button is out of contact with the one of the strings.

8. The assembly of claim 7, wherein:

the recess includes a cavity and a peripheral slot in communication with the cavity;

the button has a body and a finger extending from the body; and the body of the button is received in the cavity, and the finger of the button is received in the slot, wherein the slot limits movement of the button in directions other than along the axis.

9. The assembly of claim 7, wherein the button is biased toward the raised position.

10. The assembly of claim 7, wherein:

the button has a top and a bottom, and a post projecting from the bottom; and a spring is captured on the post and disposed in the recess between a bottom of the recess and the bottom of the button.

11. The assembly of claim 7, wherein the hole has a cylindrical inner surface.

12. The assembly of claim 7, wherein the hole has a quasi-cylindrical inner surface and a flat upper surface.

13. An assembly for an instrument, the assembly comprising:

a fretboard having a width, a length, a top surface, frets projecting from the top surface and spaced apart along the length, strings arranged above the top surface across the width, and recesses formed into the fretboard between the frets and below the strings, wherein the recesses include a cavity and a peripheral slot in communication with the cavity;

a button is carried in each recess for reciprocal movement between a raised position and a depressed position, the button having a body and a finger extending from the body, wherein the button has a hole formed transversely through the button, and one of the strings is passed through the hole;

in the depressed position, the button is in contact with the one of the strings and depresses the one of the strings against a proximate fret;

in the raised position, the button is out of contact with the one of the strings; and the body of the button is received in the cavity, the finger of the button is received in the slot, and the slot limits movement of the button in directions other than along the axis during movement between the depressed and raised positions.

14. The assembly of claim 13, wherein the button is biased toward the raised position.

15. The assembly of claim 13, wherein:

the button has a top and a bottom, and a post projecting from the bottom; and a spring is captured on the post and disposed in the recess between a bottom of the recess and the bottom of the button.

16. The assembly of claim 13, wherein the hole has a cylindrical inner surface.

17. The assembly of claim 13, wherein the hole has a quasi-cylindrical inner surface and a flat upper surface.

* * * * *